US010492597B2

(12) United States Patent
Alinski et al.

(10) Patent No.: US 10,492,597 B2
(45) **Date of Patent: *Dec. 3, 2019**

(54) TUFT PICKER FOR A TUFT-PICKING DEVICE OF A BRUSH-MAKING MACHINE

(71) Applicant: The Procter & Gamble Company, Cincinnati, OH (US)

(72) Inventors: Jens Alinski, Kelkheim (DE); Uwe Jungnickel, Königstein (DE)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 228 days.

This patent is subject to a terminal disclaimer.

(21) Appl. No.: 15/246,480

(22) Filed: Aug. 24, 2016

(65) Prior Publication Data

US 2017/0065073 A1 Mar. 9, 2017

(30) Foreign Application Priority Data

Sep. 3, 2015 (EP) ..... 15183598
Jul. 1, 2016 (EP) ..... 16177575

(51) Int. Cl.

| | |
|---|---|
| ***A46D 1/04*** | (2006.01) |
| ***A46D 3/08*** | (2006.01) |
| ***A46D 1/08*** | (2006.01) |
| ***A46D 3/04*** | (2006.01) |

(52) U.S. Cl.

CPC ..... *A46D 3/082* (2013.01); *A46D 1/08* (2013.01); *A46D 3/04* (2013.01); *A46D 3/042* (2013.01)

(58) Field of Classification Search

USPC ..... 300/2, 5, 7
See application file for complete search history.

(56) References Cited

U.S. PATENT DOCUMENTS

| | | | |
|---|---|---|---|
| 1,664,424 | A | 4/1928 | Jobst |
| 3,167,355 | A | 1/1965 | Aldrich |
| 3,606,472 | A | 9/1971 | Rutkowski |
| 4,733,917 | A | 3/1988 | Boucherie |

(Continued)

FOREIGN PATENT DOCUMENTS

| | | |
|---|---|---|
| BE | 765338 | 8/1971 |
| CN | 201468419 | 5/2010 |

(Continued)

OTHER PUBLICATIONS

International Search Report with Written opinion, dated Oct. 11, 2016, 9 pages.

(Continued)

*Primary Examiner* — Joseph J Hail
*Assistant Examiner* — Shantese McDonald
(74) *Attorney, Agent, or Firm* — Vladimir Vitenberg

(57) ABSTRACT

A tuft picker for a tuft-picking device has a working surface having a tuft-picking notch with a depth, a width, and an opening. First and second projections reduce the opening of the notch versus an inner width. At least one top of the first and/or second projection is located off-site the working surface of the tuft picker and inside of the notch. A distance from the at least one top to the working surface of the tuft picker is in the range of from 0.05 mm to 0.5 mm, and an angle between the working surface of the tuft picker and a line of reflection symmetry crossing the at least one top is from 1° to 45°.

12 Claims, 5 Drawing Sheets

(56) References Cited

U.S. PATENT DOCUMENTS

| | | | | |
|---|---|---|---|---|
| 4,968,102 | A * | 11/1990 | Boucherie | A46D 3/042 300/7 |
| 5,033,797 | A | 7/1991 | Rueb | |
| 5,165,759 | A | 11/1992 | Lewis, Jr. | |
| 2,349,532 | A | 5/1994 | West | |
| 5,344,218 | A | 9/1994 | Weihrauch | |
| 5,728,408 | A * | 3/1998 | Boucherie | A46D 3/00 264/243 |
| 6,079,788 | A | 6/2000 | Boucherie | |
| 6,086,373 | A | 7/2000 | Schiff et al. | |
| 6,138,314 | A | 10/2000 | Schiff et al. | |
| 6,290,302 | B1 | 9/2001 | Boucherie | |
| 6,290,303 | B1 | 9/2001 | Boucherie | |
| 6,905,176 | B2 | 6/2005 | Boucherie | |
| 7,635,169 | B2 | 12/2009 | Boucherie | |
| 8,172,336 | B2 * | 5/2012 | Boucherie | A46D 3/082 300/2 |
| 9,192,227 | B2 | 11/2015 | Stein et al. | |
| 2001/0026093 | A1 | 10/2001 | Boucherie | |
| 2005/0116528 | A1 | 6/2005 | Boucherie | |
| 2010/0066154 | A1 | 3/2010 | Boucherie | |
| 2012/0013169 | A1 | 1/2012 | Rees | |
| 2013/0038115 | A1 * | 2/2013 | Stein | A46D 3/045 300/2 |
| 2017/0065072 | A1 | 3/2017 | Alinski | |

FOREIGN PATENT DOCUMENTS

| | | |
|---|---|---|
| CN | 201468429 | 5/2010 |
| CN | 201468430 U | 5/2010 |
| DE | 2128774 | 10/1972 |
| DE | 3016790 | 11/1981 |
| DE | 4040297 | 6/1992 |
| DE | 4411652 | 10/1995 |
| DE | 19728442 | 1/1999 |
| DE | 19745024 | 4/1999 |
| DE | 19939333 | 2/2001 |
| DE | 20319767 | 6/2005 |
| DE | 102005045827 | 3/2007 |
| DE | 102005056968 | 5/2007 |
| DE | 102007047066 | 4/2009 |
| DE | 102008059121 | 5/2010 |
| EP | 0016508 | 10/1980 |
| EP | 0206385 | 12/1986 |
| EP | 0289676 | 11/1988 |
| EP | 0346965 | 12/1989 |
| EP | 0432868 | 6/1991 |
| EP | 0681796 | 11/1995 |
| EP | 0916283 | 5/1999 |
| EP | 1522234 | 4/2005 |
| EP | 2654501 | 10/2013 |
| GB | 418967 | 11/1934 |
| GB | 1146518 | 3/1969 |
| JP | 01254112 | 10/1989 |
| JP | 05015412 | 1/1993 |
| JP | 06277119 | 10/1994 |
| JP | 2003169719 | 6/2003 |
| WO | WO200010814 | 3/2000 |
| WO | WO200949850 | 4/2009 |

OTHER PUBLICATIONS

U.S. Appl. No. 16/449,801, filed Jun. 24, 2019, Alinski.
U.S. Appl. No. 16/449,905, filed Jun. 24, 2019, Alinski.

* cited by examiner

TUFT PICKER FOR A TUFT-PICKING DEVICE OF A BRUSH-MAKING MACHINE

FIELD OF THE INVENTION

There is provided a tuft picker for a tuft-picking device of a brush-making machine for automated production of brushes, in particular toothbrushes. A suitable tuft-picking device comprises a filament container for holding a supply of loose filaments and for providing said loose filaments to a tuft picker as disclosed herein. Said tuft picker comprises at least one tuft-picking notch in its working surface for taking up a predefined number of loose filaments from a filament container of the tuft-picking device. The at least one tuft-picking notch comprises an opening which is limited by two projections at each side. The top of at least one projection is located off-side the area of the working surface of the tuft picker, but being located inside the notch and the top of the other projection may be part of the working surface of the tuft picker or may be located off-site the working surface and inside the notch as well. Thus, the tuft-picking notch might be symmetrical. During one working stroke the working surface of the tuft picker comprising the tuft-picking notch is transferred along the loose filaments. Thereby the filaments are transferred from the filament container into the notch and the projection which is located off-side the working surface of the tuft picker keeps the filaments inside the notch.

BACKGROUND OF THE INVENTION

The bristle field of modern toothbrushes comprises multiple filament tufts. A filament tuft comprises a predefined number of individual filaments which are arranged to each other with parallel length axes. During manufacturing of toothbrushes these filament tufts are separated from a filament reservoir, also known as filament container, comprising a plurality of filaments loosely arranged with parallel length axes. One side of the filament container is open or comprises an opening so that the filaments can be transferred continuously against said opening. At the opening the filaments can be taken out by a tuft picker. Said tuft picker comprise at least one tuft-picking notch which dimension is identical to the dimension of the filament tuft to be produced. Different tuft-picking devices are known in the state of the art, e.g. devices comprising tuft-picking notches of different size (U.S. Pat. No. 7,635,169B2) or shape (US 2013/0038115 A1). However, these devices are only applicable to round filaments comprising a more or less homogeneous surface and diameter.

Toothbrush development focusses on cleaning performance looking continuously for new filaments with a different cleaning property compared to the standard round filaments. Nowadays, irregular filaments, in particular filaments comprising depressions, recesses or the like along their length axes, came into fashion as these filaments take up the removed dust and complement current cleaning performance Prominent examples for said new kind of filaments are X-shaped filaments. Unfortunately, X-shaped filaments cannot be produced with the present manufacturing devices. One problem is the picking process, as the current picking devices do not work properly for X-shaped filaments. The problems are inter alia splicing of filaments, picking different numbers of filaments up to picking no filaments and/or loosing picked filaments after having picked them so that X-shaped filament tufts cannot be formed properly at the moment. In particular splicing of filaments causes problems for the final toothbrush as sharp edges might hurt the gum of the toothbrush user.

That means, a need exists for a new tuft picker which is adapted to pick filaments comprising depressions, recess etc., including X-shaped filaments. Thus, it is the object of the present application to provide such a new tuft picker which picks filaments comprising depressions, recess etc., such as X-shaped filaments, with a high operational reliability regarding number of filaments and without any splicing.

SUMMARY OF THE INVENTION

In accordance with one aspect, there is provided a tuft picker for a tuft-picking device suitable in a brush-making machine, wherein a working surface of the tuft picker comprises at least a tuft-picking notch with a depth, a width, and an opening, wherein a first projection and a second projection reduce the opening of the tuft-picking notch versus an inner width, wherein at least one top of the first and/or second projection is located off-site the working surface of the tuft picker and inside of the notch, wherein a distance from the at least one top to the working surface of the tuft picker is in the range of from 0.05 mm to 0.5 mm and wherein an angle between the working surface of the tuft picker and a line of reflection symmetry crossing the at least one top is in the range of from 1° to 45°.

In accordance with another aspect, there is provided a tuft-picking device comprising a tuft picker as disclosed herein which can be used in a brush-making machine.

In accordance with another aspect, there is provided a method of providing filament tufts comprising a predefined number of filaments for the manufacturing of brushes, in particular toothbrushes, wherein the method uses a tuft picker as disclosed herein and wherein at least one filament of the predefined number of filaments for the filament tuft comprises a circumference which comprises at least one recess and/or is an X-shaped filament.

In accordance with another aspect, there is provided a brush, in particular a toothbrush, comprising at least on filament tuft comprising at least one filament which circumference comprises at least one recess and/or is an X-shapes filament.

BRIEF DESCRIPTION OF DRAWINGS

These and other features will become apparent not only from the claims but also from the following description and the drawings, with the aid of which example embodiments are explained below.

DETAILED DESCRIPTION OF THE INVENTION

Figure 1A:
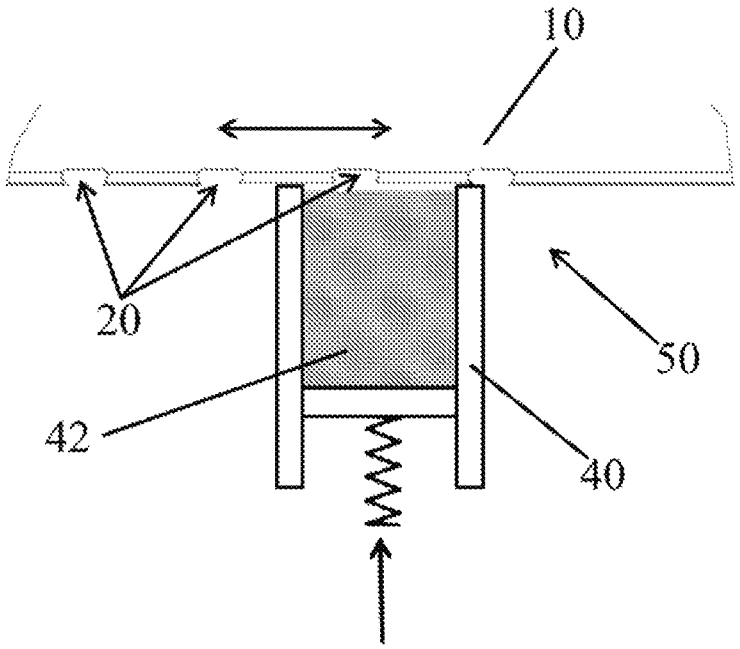
FIGS. 1A, 1B show schematic sketches of a tuft-picking device 50 for brush-making machines comprising a linear tuft picker 10 (FIG. 1A) or a circular tuft picker 10 (FIG. 1B), wherein the tuft picker comprises several tuft-picking notches 20.

The following is a description of numerous versions of a tuft picker for a tuft-picking device suitable to provide X-shaped filaments for brush production, in particular for toothbrush production. The description further discloses a method using said tuft picker which can be used to produce toothbrushes and the produced toothbrushes themselves. The tuft picker as disclosed herein can be combined with any known tuft-picking device, in particular it is used for devices adapted for anchor-free brush making processes. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In addition, single features or (sub)combinations of features may have inventive character irrespective of the feature combination provided by the claims, the respective part of the specification or the drawings.

As used herein, the word "about" means +/−10 percent. As used herein, the word "comprise," and its variants, are intended to be non-limiting, such that recitation of items in a list is not to the exclusion of other like items that may also be useful in the devices and methods of this invention. This term encompasses the terms "consisting of". As used herein, the word "include," and its variants, are intended to be non-limiting, such that recitation of items in a list is not to the exclusion of other like items that may also be useful in the devices and methods of this invention. As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments whether described herein in detail or not are not useful, and it is not intended to exclude other embodiments from the scope of the invention.

There is provided a tuft picker for a tuft-picking device which can be used in a brush-making machine. The tuft-picking device comprises a filament container for holding a supply of loose filaments in a mutually parallel condition wherein the circumference of the loose filaments comprises at least one recess. A "filament container" as understood herein shall comprise any container of any geometrical shape which is suitable to store the loose filaments in parallel. A plurality of filaments is arranged in the filament container along their length axis. That means each filament element is arranged with its length axis in parallel to the adjacent filaments. The filament container comprises one open side or an opening is present in one side wall. At that opening the filaments are exposed to the environment, in particular are exposed to a tuft picker and can be removed from the filament container by said tuft picker. Opposite to the opening of the filament container a plunger etc. might be arranged which continuously presses the loose filaments against the opening of the filament container.

Filaments may be for example monofilaments made from plastic material. Suitable plastic material used for filaments may be polyamide (PA), in particular nylon, polybutylterephthalate (PBT), polyethylterephthalate (PET) or mixtures thereof. In addition, the filament material may comprise additives such as abrasives, color pigments, flavors etc. For example an abrasive such as kaolin clay may be added and/or the filaments may be colored at the outer surface in order to realize indicator material. The coloring on the outside of the material is slowly worn away during use to indicate the extent to which the filament is worn. Suitable additives to filaments used for tuft filaments are for example UV-brighteners, signaling substances, such as the indicator color pigments and/or abrasives. The diameter of the filament may be in the range from about 0.1 mm to about 0.5 mm, in particular in the range from about 0.15 to about 0.4 mm, more particular in the range of about 0.18 to about 0.35 mm or any other numerical range which is narrower and which falls within such broader numerical range, as if such narrower numerical ranges were all expressly written herein. Filament diameters are produced with a tolerance of 10%. A "recess" as understood herein in the filament circumference, diameter and/or volume shall mean any depression, cavity, slot or other geometric recess which amends the filament volume. The filament comprising at least one recess in its circumference may comprise one or more recesses along the circumference of the filament. A suitable example for a filament comprising at least one recess is an X-shaped filament. X-shaped filaments comprise four recesses and two lines of reflection symmetry each crossing two recesses which are located opposite to each other. In addition, all four recesses might be equal. The included angle of the X-shape filaments might be in the range of from about 40° to about 160°.

Length of the filament depends on the intended use. Generally, a filament can be of any suitable length for transporting, such as about 1200 mm and in then cut into pieces of the desired length. The length of a filament in a toothbrush influences the bending forces needed to bend the filament. Thus, the length of a filament can be used to realize different stiffness of filaments in a brush pattern. The typical length of a filament for a brush, in particular a toothbrush, may be in the range from about 5 mm to about 18 mm, in particular in the range from about 6 mm to about 15 mm, more particular in the range of about 7 mm to about 13 mm or any other numerical range which is narrower and which falls within such broader numerical range, as if such narrower numerical ranges were all expressly written herein. The filaments stored in the filament container as disclosed herein are intended to be mounted to a brush by anchor free techniques, thus the filaments in the container may show the intended length for use plus the length needed for mounting of the filament into the brush. The filaments in the filament container may be longer than the final filaments in the range from about 0.5 mm to about 5 mm, in particular in the range from about 1 mm to about 4 mm, more particular in the range of about 1.5 mm to about 3 mm or any other numerical range which is narrower and which falls within such broader numerical range, as if such narrower numerical ranges were all expressly written herein. In particular, if the brushes are manufactured by anchor-free technology as intended herein, the filament ends which are intended for use are usually end-rounded before they are stored in the filament container. The process of end-rounding comprises several successive polishing steps, preferably using decreasing abrasiveness in order to remove the sharp ends of the filaments which could hurt the gums of the user of the brush.

The filaments in the brush head are grouped in filament tufts. A suitable number of filaments to form one filament tuft may be for example in the range of about 10 to about 80, or in the range of about 15 to about 60, or in the range of about 20 to about 50, or any other numerical range which is narrower and which falls within such broader numerical range, as if such narrower numerical ranges were all expressly written herein. The predefined number of filaments which shall form one filament tuft is separated from the filament container mechanically, i.e. by a picking mechanism. "Picking" as understood herein shall mean that the filaments may be pushed perpendicular to their length axis continuously from the filament container in the direction of a tuft picker having at least one tuft-picking notch able to accept the predefined number of filaments. The picked number of filaments, named filament tuft, is then transferred to a brush-making machine and mounted into a brush head.

A "tuft picker" as disclosed herein comprises a working surface comprising at least one tuft-picking notch. Said tuft-picking notch is a recess along the working surface, thus comprising a depth, a width along the depth and an opening in/at the working surface of the tuft picker. The contour of the working surface is adapted to be movable during a working stroke past an open side of the filament container. A "working stroke" as understood herein is any movement of the tuft picker which passes the opening of the tuft-picking notch along the loose filaments in a filament container, whereby filaments are pressed into the notch by the plunger of the filament container and are finally removed from the filament container.

The opening of the tuft-picking notch is reduced by two projections which reduce the width of the opening compared to the width of the internal notch. At least one top of the first or second projection is located off-site the working surface of the tuft picker and inside the notch. The top of the other projection might be located in the working surface of the tuft picker so that the top of said projection may help to separate filaments from the filament container. At least the projection which is located inside the notch is a symmetric geometric body comprising a line of reflection symmetry crossing the top of said projection. A distance from said top to the working surface of the tuft picker is in the range of from about 0.05 mm to about 0.5 mm and an angle between the working surface of the tuft picker and the line of reflection symmetry crossing the top of said projection which is located inside the notch is in the range of from about 1° to about 45°.

Additionally or alternatively, the distance from the top of the projection which is located inside the notch to the working surface of the tuft picker might be adapted to the size or thickness of the filaments to be picked. An optimal distance from the top of said projection to the working surface of the tuft picker is about a half of the thickness of the filament and/or the distance from the middle of the recess of the filament to the working surface of the tuft picker. Suitable distances are in the range of from about 0.05 mm to about 0.4 mm, preferably in the range from about 0.05 mm to about 0.35 mm more preferred in the range from about 0.08 mm to about 0.3 mm or any other numerical range which is narrower and which falls within such broader numerical range, as if such narrower numerical ranges were all expressly written herein.

Additionally or alternatively, the top of the projection which is located inside the notch projects into the tuft-picking notch in an amount which is adapted to the recess of the filaments to be picked. The projection is measured compared to a theoretical straight side wall of the notch ending at the opening. An optimal projection is about the depth of the recess so that the whole surface of the projection tangents the recess of the filament. Less projecting projections are also possible as long as the recess of the filaments is positioned reliably at the projection. Suitable projections project in the range of from about 0.025 mm to about 0.25 mm, preferably in the range of from about 0.025 mm to about 0.2 mm, more preferred from about 0.04 mm to about 0.15 mm into the tuft-picking notch or any other numerical range which is narrower and which falls within such broader numerical range, as if such narrower numerical ranges were all expressly written herein.

Additionally or alternatively, the angle between the working surface of the tuft picker and the line of reflection symmetry crossing the top of the at least one projection which is located inside the notch may be adapted to the recess of the filaments to be picked. An optimal angle is complementary to the contour of the recess so that the whole surface of the projection tangents the recess of the filament. Suitable angles are in the range of from about 1° to about 45°, preferably in the range of from about 3° to about 40°, more preferred in the range of from about 3° to about 35°, more preferred in the range of from about 5° to 30°, more preferred in the range of from 5° to about 20°, more preferred in the range of from about 8° to about 15° or any other numerical range which is narrower and which falls within such broader numerical range, as if such narrower numerical ranges were all expressly written herein.

Additionally or alternatively, the top of the first and the second projection might be located off-site the working surface of the tuft picker so that both projections are located inside the notch and their tops being spaced from the working surface of the tuft picker by a distance as disclosed herein. The distances between the top of the first projection and the working surface might be equal or different to the distance between the top of the second projection and the working surface of the tuft picker. The angle between the working surface of the tuft picker and the line of reflection symmetry crossing the top of the first projection might be equal or different to the angle between the working surface of the tuft picker and the line of reflection symmetry crossing the top of the second projection. If the distance and the angle between the top of the two projections and the working surface are equal the notch shows a symmetrical opening and can be preferably used for tuft pickers which pick filaments from a filament container in two directions.

The contour of the working surface of a tuft picker may be straight. Straight tuft pickers show a linear working surface and a working stroke with a straight tuft picker is usually a linear movement. Straight tuft pickers may be used bidirectionally. Bidirectionally used tuft pickers preferably comprise symmetrical notches comprising an off-side located projection at each side of the opening. Alternatively, the contour of the working surface of a tuft picker may be a circular arc which comprises preferably a curvature/diameter in the range from about 80 mm to about 300 mm, more preferred with a curvature/diameter in the range from about 100 mm to about 200 mm or any other numerical range which is narrower and which falls within such broader numerical range, as if such narrower numerical ranges were all expressly written herein. The working stroke of a circular tuft picker is usually a circular movement with a radius depending on the contour of the tuft picker. The angle between the line of reflection symmetry of the projection(s) located inside the notch and the working surface of the tuft picker is measured between the line of reflection symmetry of said projection and the tangent tangenting the working surface of the tuft picker at the middle of the tuft-picking notch for circular tuft pickers. The tuft pickers as disclosed herein comprise at least one tuft-picking notch. If a higher picking frequency is intended the tuft picker may comprise more than one notch. Preferably, the tuft picker may comprise in the range of from 3 to 10 notches. If the tuft picker comprises more than one notch, the notches are spaced by a distance. The distance between two notches is at least large enough to resist the mechanical forces during a working stroke.

Additionally or alternatively, the tuft-picking notch can principally be of any geometrical form. Suitable forms are, for example, a circle, an oval, a polygon, preferably a convex polygon, a cyclic polygon, a regular square, an irregular square, a polygon with rounded angles or any combination thereof. The form of the tuft-picking notch is chosen such that the filaments to be picked are trapped inside the notch. In particular, any active removal from the notch such as swirls which might be formed in the notch shall be avoided by the form of the tuft-picking notch as disclosed herein. Preferably the tuft-picking notch is a cyclic polygon, in particular a cyclic polygon with rounded angles. The internal surface of the tuft-picking notch may be regularly or irregularly. An irregular internal surface of the tuft-picking notch is preferred as any movement of the filaments in the notch is inhibited thereby. In addition, the tuft-picking notch may comprise a symmetrical form, in particular the tuft-picking notch may comprise a line of reflection symmetry which ranges preferably from the middle of the opening to the middle of the bottom of the notch. Said symmetric notches are in particular suitable for tuft picker which work bidirectional.

Additionally or alternatively, the width of the tuft-picking notch may vary along the depth of the notch. That means the width at the bottom of the tuft-picking notch may be larger than the width of the opening of the notch and/or the width at the bottom of the tuft-picking notch may be larger than the width at the projections reaching into the notch and/or larger than the width beyond the projections. Variation of the width along the depth of the notch helps in keeping the filaments in the notch during the movement of the tuft picker. Additionally or alternatively, the depth of the tuft-picking notch may vary along its width.

Additionally or alternatively, the width of the tuft-picking notch may be larger than the depth of the tuft-picking notch. Said oblongness may help to pick filaments comprising at least one recess as well to keep the filaments in the tuft-picking notch during the movement of the tuft picker. For example, the width may be in the range from about 0.5 mm to about 10 mm and/or the depth may be in the range of from about 0.5 mm to about 5 mm or any other numerical range which is narrower and which falls within such broader numerical range, as if such narrower numerical ranges were all expressly written herein.

Additionally or alternatively, the depth of the tuft-picking notch can be adapted between two successively performed working strokes. By varying the depth of the tuft-picking notch, the size of the tuft-picking notch is varied. The size of the tuft-picking notch corresponds to the predefined number of filaments picked which form one filament tuft after picking. That means, if the size of the tuft-picking notch is varied, different filament tufts can be picked with one tuft picker. The size of the tuft-picking notch may be varied between each working stroke or more than one working stroke with each notch size are performed successively in order to speed up the picking process.

Additionally or alternatively, the internal surface of the tuft-picking notch might be irregular or regular. For example an irregular internal surface might comprise one, more or a plurality of depressions and/or elevations. That means the internal surface might be e.g. undulated. If the internal surface is irregular, the whole internal surface or a part thereof might comprise the depressions and/or elevations. For example, the bottom and/or the side walls of the notch comprise depressions and/or elevations and/or are undulated. An irregular internal surface is preferred as it keeps the picked filaments located at their place in the tuft-picking notch. In particular, internal movements, like swirls are inhibited thereby.

Additionally or alternatively, the tuft-picking notch may comprise a third projection which is located inside of the notch adjacent to the at least one projection which top is arranged off-side the working surface of the tuft picker. If both projections at both sides of the opening are arranged off-side the working surface of the tuft picker the tuft-picking notch may comprise additionally a fourth projection which is also located inside the notch and adjacent to the off-side located notch. Said third and/or fourth projection may be similar or differently formed compared to the other two projections, in particular the third and/or fourth projection may be similar formed compared to its adjacent projection. For example, the third and/or fourth projection may be symmetrically shaped having a line of reflection symmetry crossing a top of the third and/or fourth projection. The angle between said line of reflection symmetry and the working surface of the tuft-picking notch may be equal or smaller than the angle between the adjacent projection and the working surface. Preferably, the angle between the third and/or fourth projection and the working surface is about 10° smaller than the angle between its adjacent projection and the working surface.

Additionally or alternatively, the top of the third and/or fourth projection may project less into the notch than the top of its adjacent projection, preferably the top of the third and/or fourth projection may projects about 5% less, about 10% less, about 15% less or any other numerical range which falls within such broader numerical range, as if such narrower numerical ranges were all expressly written herein into the notch than its adjacent projection.

The third and/or fourth projection may further help to trap the picked filaments inside the notch. Therefore it might be helpful, if the width of the tuft-picking notch at the bottom of the notch may be larger than at and/or beyond the third/and or fourth projection. For example, adjacent to the third and/or fourth projection might be arranged a depression in order to trap a filament located there securely. Additionally or alternatively, a top of the third and/or fourth projection is spaced from the top of its adjacent projection with a distance which is equal to the distance from the top of said adjacent projection to the working surface of the tuft picker. Additionally or alternatively, the distance between the third and/or fourth projection and its adjacent projection might be about 10% shorter or about 10% larger than the distance from the top of said adjacent projection to the working surface of the tuft picker.

Additionally or alternatively, the present disclosure provides further a method of providing filament tufts for brush making production, in particular for toothbrush making production. Said filament tufts comprise a predefined number of filaments, wherein at least one filament comprises a circumference which comprises at least one recess. A "predefined number of filaments" as understood herein means a number which is set by the size of the tuft-picking notch of the tuft picker as disclosed herein and which is used in a picker device. Said predefined number may vary in the number of the selected and picked filaments in range of about 25% above or below the set number. The method comprises using at least a tuft picker as disclosed herein and comprises further separating laterally the filaments from a quantity of loose fibers in order to form a filament tuft. The filaments picked comprise preferably four recesses, in particular, the filaments picked with the method as disclosed herein are X-shaped filaments.

Additionally or alternatively, the present disclosure provides further a brush, in particular a toothbrush comprising at least on filament tuft comprising at least one filament which circumference comprises at least one recess. Said brush is manufactured using a method and/or a tuft picker as disclosed herein. Preferably, the brush and/or toothbrush produced comprise at least one filament tuft comprising X-shaped filaments.

In the following, a detailed description of several example embodiments will be given. It is noted that all features described in the present disclosure, whether they are disclosed in the previous description of more general embodiments or in the following description of example embodiments of the devices, even though they may be described in the context of a particular embodiment, are of course meant to be disclosed as individual features that can be combined with all other disclosed features as long as this would not contradict the gist and scope of the present disclosure. In particular, all features disclosed for either one of the device or a part thereof may also be combined with and/or applied to the other parts of the device or a part thereof, if applicable.

Figure 1B:
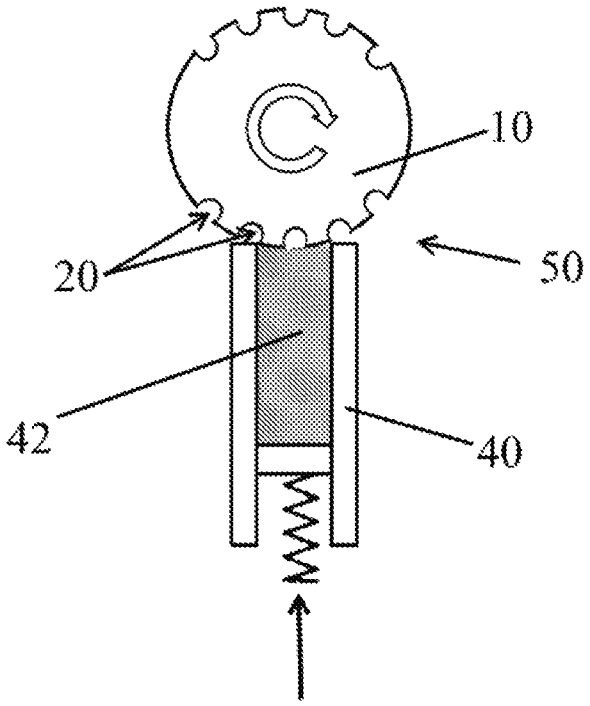

FIGS. 1A and 1B show a schematic view of two different tuft-picking devices 50 for brush-making machines which preferably use an anchor-free process for mounting filament tufts into a brush, in particular into a toothbrush. The tuft-picking devices 50 comprise at least a tuft picker 10 and a filament container 40. Further components which might belong to the tuft-picking device 50 are not shown in order to facilitate FIGS. 1A and 1B. The filament container 40 is suitable for holding a plurality of loose filaments 42 in a mutually parallel condition. That means the filaments 42 are located with parallel length axes in the filament container 40, wherein the length axes of the filaments 42 are parallel to the side walls of the filament container 40. The filaments 42 may be for example monofilaments made from plastic material such as polyamide (PA), in particular PA 6.10 or PA 6.12. The diameter of the filament may be in the range from about 0.1 mm to about 0.5 mm or and the filaments may be cut into pieces of a length in the range of about 7 mm to about 13 mm.

The filament container 40 may be of any geometrical shape as long as the filaments 42 can be stored therein. For examples, the filament container 40 comprises two side walls which are immovable, one movable side wall and one open side. The movable side wall is located opposite to the open side and is moved into the direction of the open side, thereby moving the plurality of filaments 42 stored in the filament container 40 in the same direction. At the open side the filaments 42 are in contact with one of the different tuft pickers 10.

The tuft picker 10 shown in FIG. 1A comprises four tuft-picking notches 20 which are each suitable to take up filaments 42 from the filament container 40. The surface contour of the tuft picker 10 is straight or linear. Said kind of tuft picker 10 might also be named a picker bar. The tuft picker 10 is attached to the tuft-picking device 50 in such that the tuft picker 10 can be moved linearly. The movement is a bidirectional linear movement along the open side of the filament container 40. Thus, a working stroke, —meaning the movement of the tuft picker 10 that brings at least one tuft-picking notch 20 into contact with the filaments 42 located in the filament container 40—is a linear movement in one direction. Preferably, the tuft picker 10 is moved along the open side of the filament container 40 until all tuft-picking notches 20 are filled with filaments 42. Then, in the position outside the filament container 40 the filaments 42 can be removed from the tuft-picking notches 20 in order to be mounted to a brush. Then the tuft picker 10 can be moved in the reverse direction for a further working stroke in order to fill the tuft-picking notches again.

The tuft picker 10 shown in FIG. 1B comprises ten tuft-picking notches 20 which are each suitable to take up filaments 42 from the filament container 40. The surface contour of said tuft picker 10 is a circle. Five tuft-picking notches 20 are arranged at opposite halves of the circular tuft picker 10. The tuft picker 10 is attached to the tuft-picking device 50 in such that the tuft picker 10 can be moved circularly. The movement is a unidirectional circular movement along the open side of the filament container 40. A working stroke, —meaning the movement of the tuft picker 10 that brings at least one tuft-picking notch 20 into contact with the filaments 42 located in the filament container 40—is a circular movement in one direction. In the embodiment shown in FIG. 1B a working stroke of the tuft picker 10 corresponds to the movement along the open side of the filament container 40 until five tuft-picking notches 20 at one side of the tuft picker 10 are filled with filaments 42. In this position the other five tuft-picking notches 20 are located outside the area of the filament container 40 so that the filaments 42 can be removed from said tuft-picking notches 20 easily. That means charging and discharging of five and five tuft-picking notches 20 takes place respectively.

Figure 2A:
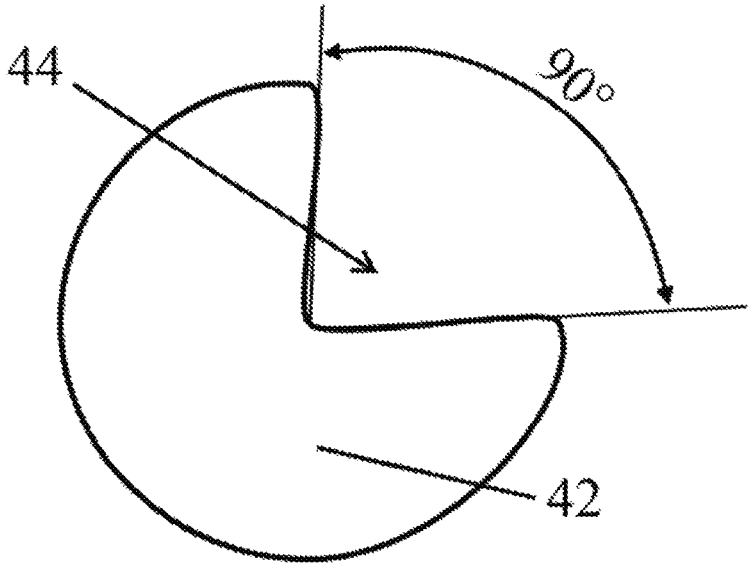
FIG. 2A shows a sectional view of a filament 42 comprising on recess 44 in its circumference.
Figure 2B:
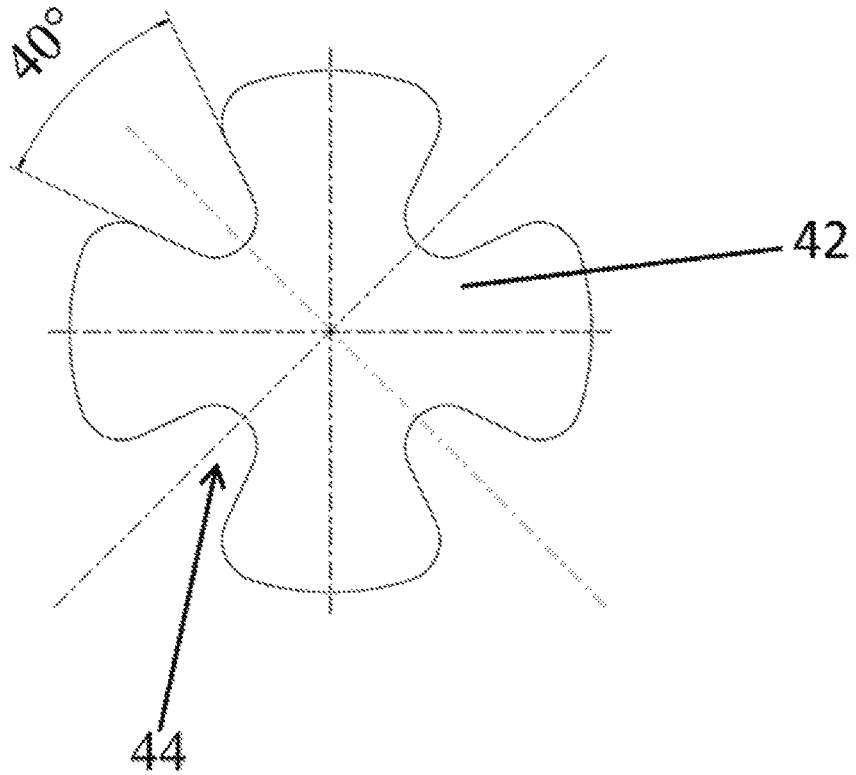
FIGS. 2B, 2C, 2D show sectional views of three different filaments 42 comprising four recesses 44 in their circumference, thus being X-shaped, different included angles are shown
Figure 2C:
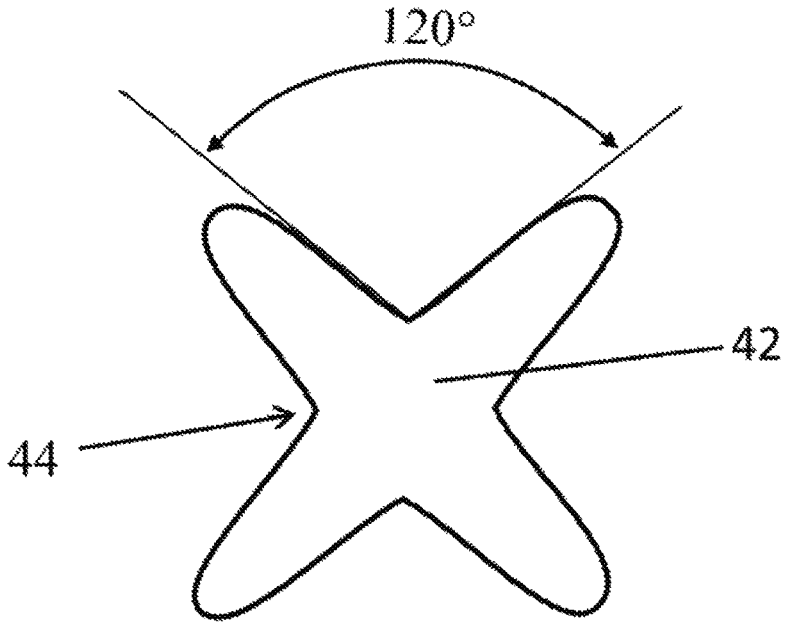
Figure 2D:
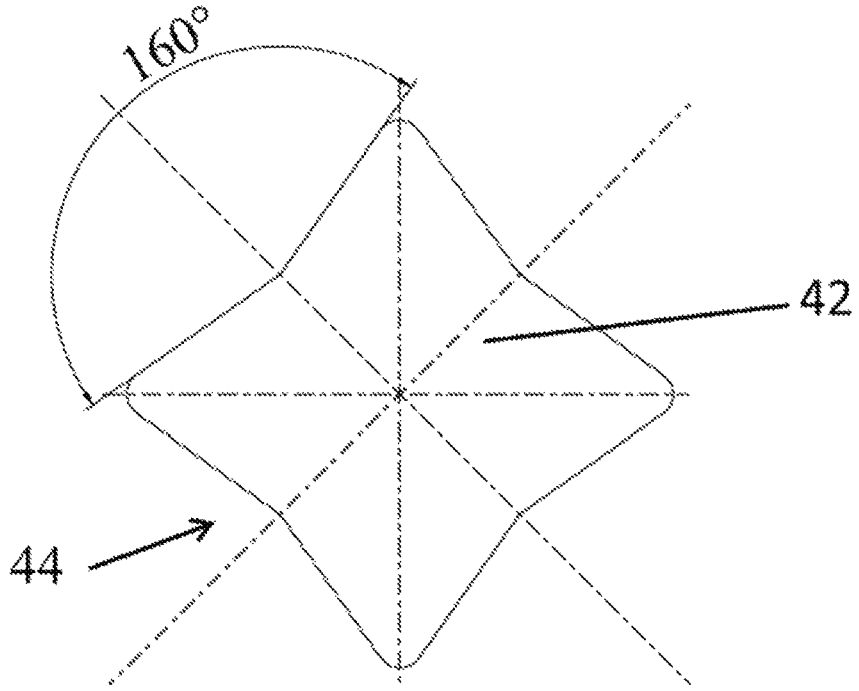

FIG. 2A shows a schematic sketch of a filament 42 comprising one recess 44 in its circumference. The recess 44 might be until the middle of the filament 42 as shown or might be less deep. The included angle of the recess 44 is about 90°. The diameter of the filament 42 may be in the range of from about 0.18 mm to about 0.35 mm. FIGS. 2B, 2C and 2D show a filament 42 comprising four recesses 44 in their circumference, respectively. The four recesses 44 are arranged regularly around the circumference of the filament 42, thereby forming an X-shaped filament. Different forms and sizes of recesses are shown in FIGS. 2B, 2C and 2D. The maximal dimension of an X-shaped filament 42 may be in the range of from about 0.18 mm to about 0.35 mm. The included angle of each of the recesses 44 of the X-shaped filament 42 may be in the range of from about 40° to about 160°. Different included angles are shown, namely 40° (FIG. 2B), 120° (FIG. 2C) and 160° (FIG. 2D). The depth of the recesses 44 is less than until the middle of the filament in order to have a robust bulk in the middle of the filament 42. The four recesses 44 may be equal to each other in form, shape, size and opening angle as shown or may be different to each other. Regarding X-shaped filaments 42 at least the two opposite recesses 44 are preferably equally formed compared to each other.

Figure 3A:
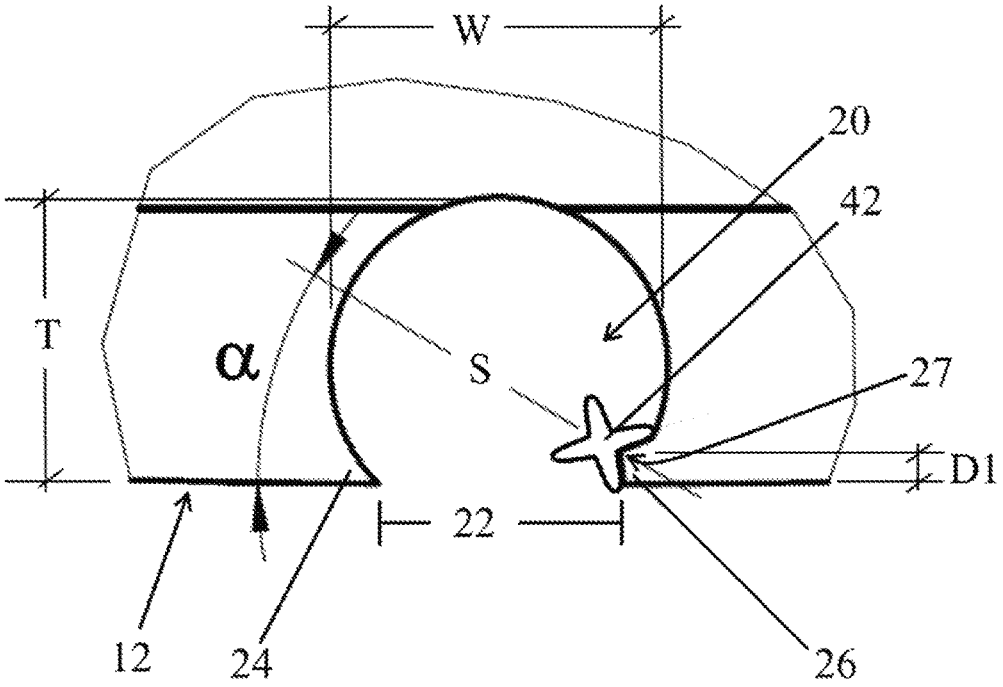
FIG. 3A shows a schematic sketch of one embodiment of the tuft-picking notch 20 having a protrusion 26 located off-site a working surface 12 of the notch 20.

FIGS. 3A and B shows schematically two embodiments of a tuft-picking notch 20 which might be located in a tuft picker 10 as shown in FIG. 1. In FIG. 3A the tuft-picking notch 20 comprises a first protrusion 24 comprising a top 25 which is located in the layer of the working surface 12 of the tuft-picking notch 20. That means a top 25 of the first projection 24 limits an opening 22 of the tuft-picking notch 20. In addition, the tuft-picking notch 20 comprises a second protrusion 26 which top 27 is located off-site the working surface 12 of the notch 20. "Located off-site" means herein that the second protrusion 26 is located inside of the notch 20, in particular the top 27 of the second protrusion 26 is located inside the tuft-picking notch 20. That means the opening 22 is not limited by the top 27 of the second protrusion 26. A distance D1 from the top 27 of the second protrusion 26 to the working surface 12 and the projection of the top 27 into the notch 20 are in the range of about 0.08 mm to about 0.3 mm.

The second projection 26 is formed symmetrically, thus comprising a line of reflection symmetry S crossing the top 27 of the projection 26. The angle α between the working surface 12 of the tuft picker 10 and the line of reflection symmetry S crossing the top 27 of the second projection 26 is in the range of about 30°. If the contour of the tuft picker 10 is linear the angle α is measured between the line of reflection symmetry S of the second projection 26 and the working surface 12. If the contour of the tuft picker 10 is circular the angle α is measured between the line of reflection symmetry S of the second projection 26 and the tangent tangenting the working surface 12 of the tuft picker 10 at the middle of the opening 22 of the tuft-picking notch 20. If the tuft picker 10 is a circular arc the circular arc comprises preferably a curvature/diameter in the range from 80 mm to 300 mm, more preferred with a curvature/diameter in the range from 100 mm to 200 mm.

Figure 3B:
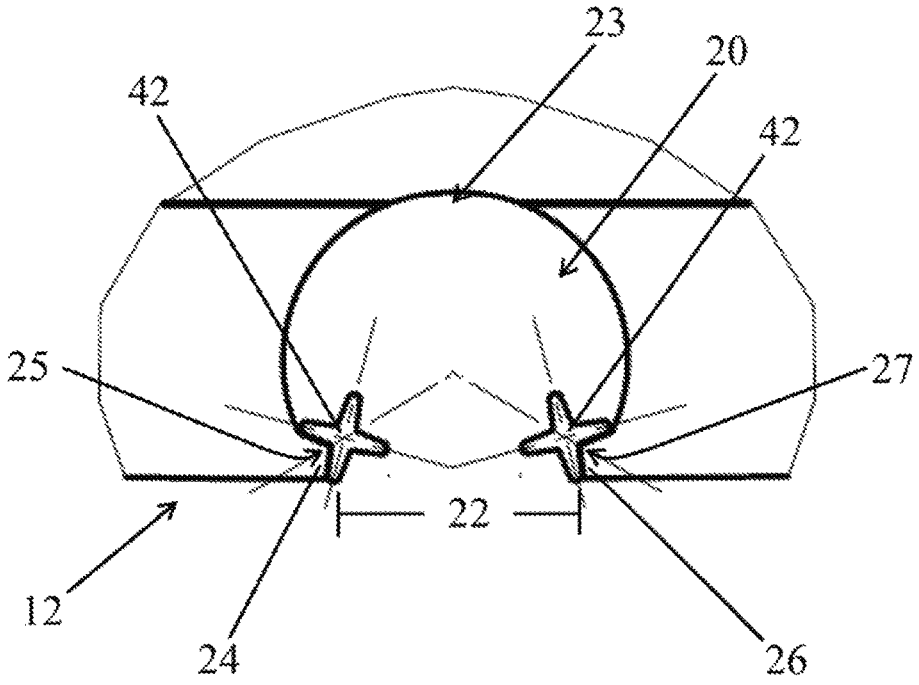
FIG. 3B shows a schematic sketch of one embodiment of the tuft-picking notch 20 having both protrusions 24, 26 located off-site a working surface 12 of the notch 20.

FIG. 3B shows an alternative embodiment of the tuft-picking notch 20 shown in FIG. 3A. Features which are in common with the tuft-picking notch 20 shown in FIG. 3A are designated with the same reference numerals and are not described in detail again. The tuft-picking notch 20 shown in FIG. 3B is a symmetrical notch 20. That means the first projection 24 and the second projection 26 are formed equally and located equally on both sides of the opening 22 so that the tuft-picking notch 20 comprises a line of reflection from the middle of the opening 22 to the middle of the bottom 23 of the notch 20. Thus, the top 25 of the first projection 24 and the top 27 of the second projection 26 are located off-site the working surface 12 of the notch 20. An angle α is measured between the line of reflection symmetry S of the first and second projections 24, 26 and the working surface 12. In order to realize a symmetrical notch 20 the angle α and the distance D1 for the first and second projection 24, 26 are identical. The angle α might be about 30°, the distance D1 and the projection of the tops 25, 27 into the notch 20 might be in the range of about 0.08 mm to about 0.3 mm.

The tuft-picking notch 20 shown in FIGS. 3A and 3B is a circular notch 20. Thus, the width W is identical to the diameter of the circular notch 20. A suitable width W is in the range of from about 0.5 mm to about 5 mm. The depth T of the tuft-picking notch 20 ranges from a bottom 23 of the notch 20 to the opening 22 of the notch 20. The depth T is smaller than the width W due to the flat opening 22. A suitable depth T is in the range of from about 0.5 mm to about 4 mm.

Figure 4:
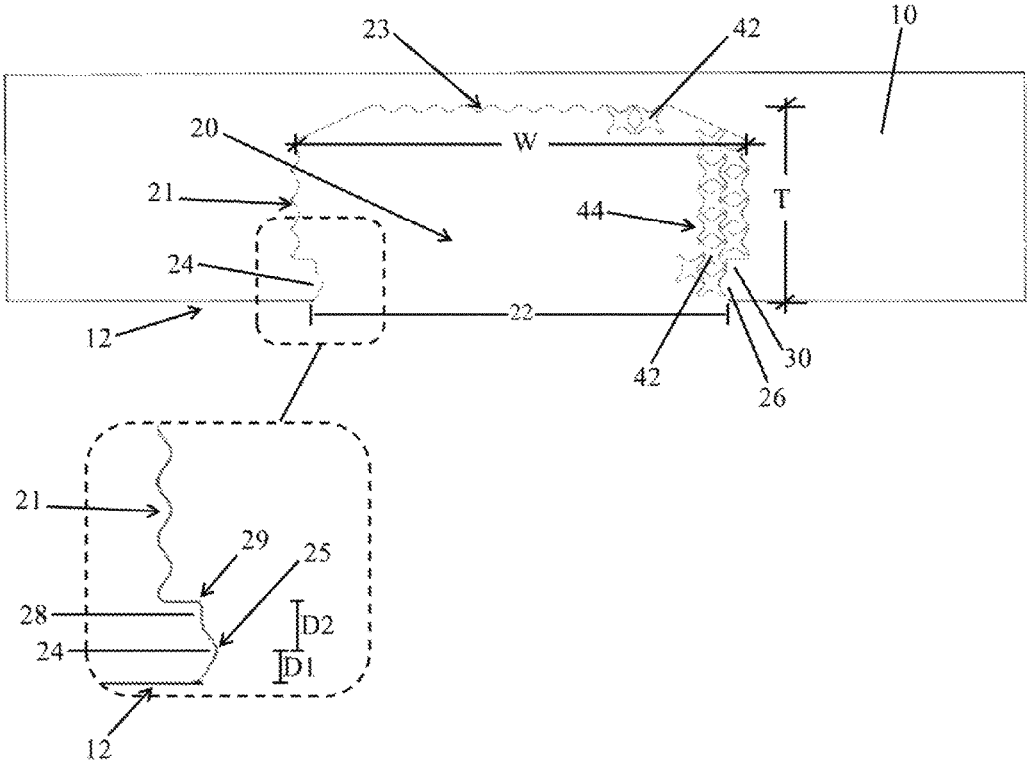
FIG. 4 shows a schematic sketch of another embodiment of the tuft-picking notch 20 comprising an undulated bottom 23 and undulated side walls 21.

FIG. 4 shows another embodiment of a tuft-picking notch 20. Features which are in common with the tuft-picking notches 20 shown in FIG. 3 are designated with the same reference numerals and are not described in detail again. The tuft-picking notch 20 shown in FIG. 4 has four protrusions 24, 26, 28, 30. The first protrusion 24 and the second protrusion 26 are located off-site the working surface 12 at opposite sides of the opening 22. The third protrusion 28 is located adjacent to the first protrusion 24 inside of the tuft-picking notch 20 and the fourth protrusion 30 is located adjacent to the second protrusion 26 inside of the tuft-picking notch 20. A distance D1 from the top 25 of the first protrusion 24 to the working surface 12 is in the range of about 0.08 mm to about 0.3 mm a distance D1 from the top of the second protrusion 26 to the working surface 12 is in the same range. A distance D2 from the top 29 of the third protrusion 28 to the top 25 of the first protrusion 24 is smaller than the distance D1, in particular about 10% smaller than the distance D1. A distance D2 from the top of the fourth protrusion 30 to the top of the second protrusion 26 is the same than between the first and third protrusion. Thus, the tuft-picking notch 20 is symmetrically formed. That means the four projections 24, 26, 28, 30 are also symmetrically formed. The angle α between the working surface 12 of the tuft picker 10 and the line of reflection symmetry S crossing the tops of the first and second projections 24, 26 is in the range of about 30°. The angle α between the working surface 12 of the tuft picker 10 and the line of reflection symmetry S crossing the tops of the third and fourth projections 28, 30 is in the range of about 30-60°. The third and fourth projections 28, 30 project about 10% less into the notch 20, i.e. the tops of the third and fourth projections 28, 30 project less into the notch 20 than the tops of the first and second projections 24, 26 and the opening 22 is smaller than the width W of the notch 20.

The tuft-picking notch 20 shown in FIG. 4 is a rectangle, wherein the side walls 21 and the bottom 23 of the notch 20 are irregularly shaped, e.g. wherein the side walls 21 and the bottom 23 of the notch 20 are undulated comprising alternating depressions and elevations. In addition the edges of the rectangle are flattened. The depth T of the tuft-picking notch 20 ranging from the base of the bottom 23 to the opening 22 of the notch 20 is in the range of from 0.5 mm to 3 mm, wherein the elevations at the bottom are about 0.05 mm. The width W of the notch 20 measured at the base of the side walls 21 is in the range of from 1.5 mm to 6 mm, wherein the elevations at the bottom are about 0.05 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tuft picker (10) for a tuft-picking device (50), wherein a working surface (12) of the tuft picker (10) comprises at least a tuft-picking notch (20) with a depth (T), a width (W) and an opening (22), the notch having a contour including at least a first projection (24) and a second projection (26) opposite to the first projection, wherein each of the first and second projections has a top (25, 27) located inside the notch (20), wherein the notch comprises at least a third projection adjacent to the first projection and having a top located inside the notch.

2. The tuft picker according to claim 1, wherein the notch comprises at least a fourth projection adjacent to the second projection and having a top located inside the notch.

3. The tuft picker (10) according to claim 2, wherein at least one of the top (29) of the third projection (28) and the top (31) of the fourth projection (30) projects less into the notch (20) than at least one of the tops (25, 27) of the first and second projection (24, 26) does.

4. The tuft picker (10) according to claim 2, wherein the width (W) of the notch (20) varies along the depth (T) of the notch (20), wherein the width (W) at a bottom (23) of the notch (20) is larger than the width located beyond the first and second projections (24, 26) or beyond the third and fourth projections (28, 30).

5. The tuft picker (10) according to claim 1, wherein the working surface (12) of the tuft picker (10) is a linear surface or a circular arc comprising a curvature/diameter from 80 mm to 300 mm.

6. The tuft picker (10) according to claim 1, wherein a distance (D1) from the at least one top (25, 27) of the first and/or second projection (24, 26) to the working surface (12) is from 0.05 mm to 0.4 mm.

7. The tuft picker (10) according to claim 1, wherein the top (25, 27) of the first and/or second projection (24, 26) projects from 0.025 mm to 0.25 mm into the notch (20).

8. The tuft picker (10) according to claim 1, wherein the width (W) of the tuft-picking notch (20) is larger than the depth (T) of the tuft-picking notch (20).

9. The tuft picker (10) according to claim 1, wherein the tuft-picking notch (20) is in the form selected from the group consisting of a circle, an oval, a polygon, a convex polygon, a cyclic polygon, a polygon with rounded angles, a regular square, an irregular square, and any combination thereof.

10. The tuft picker (10) according to claim 1, wherein the notch (20) comprises a line of reflection symmetry (S), from the middle of the opening (22) to the middle of the bottom (23).

11. The tuft picker (10) according to claim 1, wherein the contour of the notch (20) comprises a plurality of depressions and elevations.

12. The tuft picker (10) according to claim 11, wherein at least one of the depressions and elevations is arranged adjacent to at least one of the first projection and the second projection or adjacent to at least one of the third projection and the fourth projection.

* * * * *